United States Patent [19]

Lundström

[11] Patent Number: 4,497,174

[45] Date of Patent: Feb. 5, 1985

[54] POWER CONTROL DEVICE FOR A DOUBLE-ACTING MULTI-CYLINDER HOT GAS ENGINE

[76] Inventor: Lennart Lundström, Ättehögsvägen 15, S-230 44 Vintrie, Sweden

[21] Appl. No.: 460,597

[22] Filed: Jan. 24, 1983

[51] Int. Cl.[3] ..... F02G 1/06

[52] U.S. Cl. ..... 60/521; 60/517

[58] Field of Search ..... 60/521, 522, 525; 62/6

[56] References Cited

U.S. PATENT DOCUMENTS

| | | | |
|---|---|---|---|
| 3,902,321 | 9/1975 | Bergman | 60/521 |
| 3,999,388 | 12/1976 | Nystrom | 60/521 |
| 4,267,696 | 5/1981 | Lindskoug | 60/526 |

FOREIGN PATENT DOCUMENTS 1383860 2/1975 United Kingdom .

OTHER PUBLICATIONS

"United Stirling" brochure, dated 1977.

*Primary Examiner*—Stephen F. Husar

*Attorney, Agent, or Firm*—Finnegan, Henderson, Farabow, Garrett & Dunner

[57] ABSTRACT

A power control device for a hot gas engine comprises continuously communicating connections between each working gas charge undergoing cyclic pressure variations and a conduit network containing gas at mean pressure. The connections are provided with capillary tubes allowing passage of low-rate flows of gas but preventing transmission of rapid pressure fluctuations. The conduit network is connected through control valves to a gas reservoir and gas compressor, which enable the mean pressure to be increased or decreased.

3 Claims, 2 Drawing Figures

POWER CONTROL DEVICE FOR A DOUBLE-ACTING MULTI-CYLINDER HOT GAS ENGINE

FIELD OF THE INVENTION

The present invention relates to a power control device for a double-acting, multi-cylinder hot gas engine of the type in which each cylinder contains a piston dividing the interior of the cylinder into two variable volume chambers containing working gas kept at different temperature levels, the high temperature chamber in one cylinder being connected to a low temperature chamber of a neighbouring cylinder via a heater, regenerator and a cooler connected in series, the mass of working gas in the engine being variable through valve-controlled connections to a gas reservoir and a gas compressor.

DESCRIPTION OF THE PRIOR ART

Hot gas engines provided with power controls of the type referred to above have been described, e.g., in U.K. Patent No. 1383860, in U.S. Pat. No. 3,902,321, and in the U.S. Pat No. 4,267,696. In the known type of power control devices each charge of working gas in the engine is provided with two check valve-governed tube connections. One of said connections is a part of a minimum working cycle gas pressure tube network which is valve connected to a gas reservoir. The other connection is a part of a maximum working cycle gas pressure tube network which is valve connected to a compressor.

To increase the power of the engine, the valve connection to the gas reservoir—containing gas at a high pressure—is opened. Gas will now enter into the tube network containing minimum working cycle gas pressure and thus increase said pressure. This will in turn increase the means pressure as well as the maximum pressure of the gas in the working gas charges of the engine.

Correspondingly, to decrease the power of the engine, the valve connection to the compressor is opened. Gas at maximum working gas cycle pressure will now be sucked into the compress, the delivery side of which is connected to the gas reservoir via a check valve. The maximum working gas cycle pressure will now be lowered as will the the mean pressure and the minimum pressure in the working gs charges. This will cause a corresponding change in the power output of the engine, the output being almost proportional to the mean gas pressure in the working gas charges—provided that the speed and the temperatures of the engine are kept constant.

The proper functioning of the engine is dependant on the proper action of the two check valves located adjacent to each working gas charge. The check valves are active during the performance of each working cycle i.e., their number of activities correspond to the number of revolutions of the engine. Therefore, in the case of engines to be used during very long intervals—e.g., for generation of electric power—the check valves might be critical elements for determination of reliability.

SUMMARY OF THE INVENTION

The object of the invention is to provide a power control device in which the use of continuously operating check valves may be omitted. This is achieved in the present invention by providing each cold gas connection between a low temperature variable volume chamber and its adjacent cooler with a single gas conduit including a capillary tube, the conduits being connectable to the reservoir and the compressor.

DESCRIPTION OF THE PREFERRED EMBODIMENT

Figure 1:
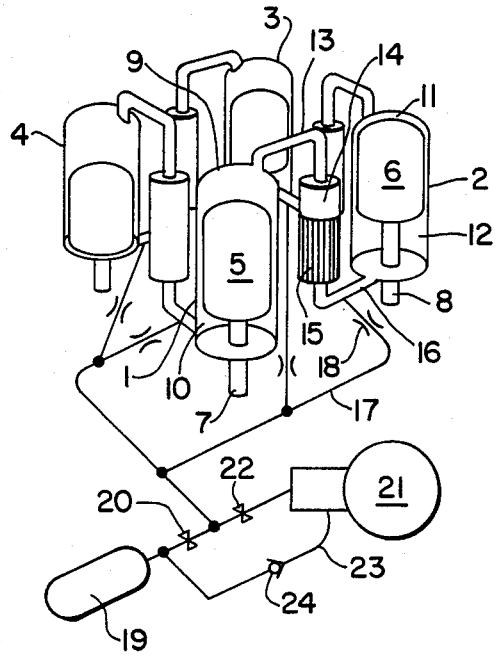
FIG. 1 is a schematic of a power control device according to the invention, being used with a double-acting, four cyclinder hot gas engine.

Reference will now be made to the preferred embodiment of the invention shown in the drawing.

The hot gas engine shown in FIG. 1 comprises four cylinders 1, 2, 3 and 4 arranged in parallel square formation. The cylinders are indentical, and only the cylinders 1 and 2 will be described below. The cylinders 1 and 2 contain pistons 5 and 6 connected to piston rods 7 and 8. The piston 5 divides the interior of the cylinder 1 into two variable volume chambers 9 and 10 the upper chamber 9 being kept at a temperature of about 700 degrees Celsius while the lower chamber 10 is kept at temperature of about 60 degrees Celsius. Correspondingly, the piston 6 in the cylinder 2 separates two chambers 11 and 12.

The upper chamber 9 of the cylinder 1 is connected to the lower chamber 12 of the cylinder 2 via a heater 13, a regenerator 14, a cooler 15, and a cold gas connection 16.

The cold gas connection 16 is provided with a branched-off gas conduit 17 including a capillary tube 18, the conduit 17 being connectable either to a gas reservoir 19 by means of a valve 20 or to a compressor 21 by means of a valve 22. It will be understood that the power control device shown in FIG. 1 comprises four branched-off gas conduits of the type designated by 17 and that all such conduits are interconnected and simultaneously connected to the reservoir 19 by the valve 20 or to the compressor 21 by the valve 22. The delivery side of the compressor 21 is connected to the reservoir 19 via a tube 23 containing a check valve 24.

The device shown in FIG. 1 and described above will operate as follows.

During operation of the hot gas engine shown in FIG. 1, the pressure of each working gas charge limited by the upper side of the piston in one cylinder and the lower side of the piston in an adjacent cylinder will vary cyclically between maximum and a minimum. Due to the restrictions provided by the capillary tubes 18, the gas pressure in the system of conduits 17 will remain at about the mean of the maximum and minimum pressures of the working gas charges. For example, if the engine were run at 1800 rpm, each working gas charge would vary in pressure between a maximum of about 20 MPa (Megapascal) and a minimum of about 10 MPa. The resulting gas pressure in the system of conduits would be about 15 MPa.

If the power output is to be increased the valve 20 is opened, and gas will pass from the reservoir 19 into the four working gas charges of the engine, increasing the mean pressure of the working gas. Correspondingly, if the power output is to be decreased the valve 22 is opened, causing gas to be sucked from the conduit system 17 into the compressor 21, which in turn will deliver the gas to the reservoir 19. The mean gas pressure in the engine will now be lowered, causing an almost proportional decrease in power output.

Figure 2:
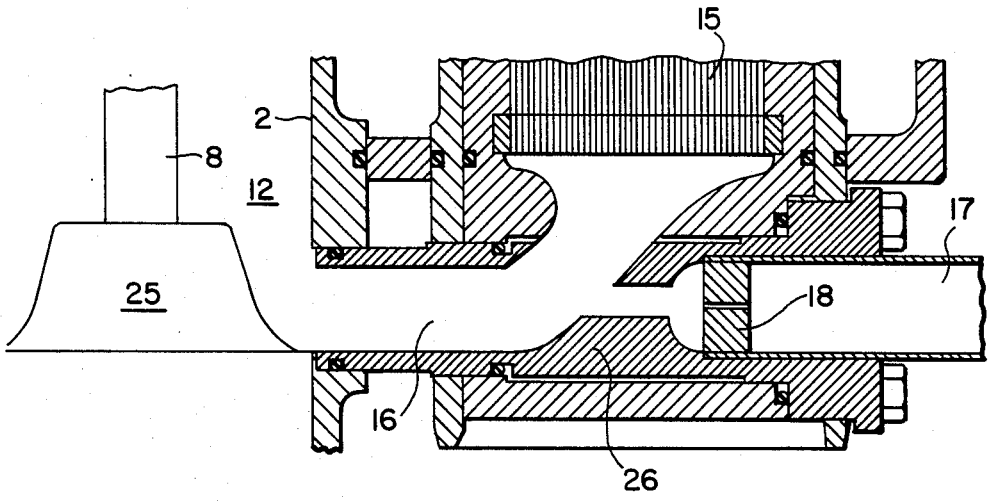
FIG. 2 is a vertical section of a part of a hot gas engine shown in FIG. 1, illustrating the connection between the cold gas connection and the gas conduit including a capillary tube.

The practical way of providing the capillary tube is shown in FIG. 2. Here the lower part of the cylinder 2 is shown having a cylinder bottom 25 through which the piston rod 8 is passed. The lower variable volume chamber 12 is connected to the upper variable volume chamber 9 of the cylinder 1 through a path only partly shown in FIG. 2. In the path the cold gas connection 16 and the cooler 15 are shown.

A gas conduit 17 including a capillary tube 18 is brazed in a bore of a wall element 26 partly limiting the cold gas connection 16. The bore in the capillary tube 18 may be of 0.5 mm diameter and 2 mm length in a hot gas engine having a piston-swept volume of about 100 $cm^3$ in each cylinder. Alternatively (not shown) the capillary bore may be shaped as a larger bore having a diameter of 1.0 mm containing a centrally mounted cylindrical pin having a diameter of 0.9 mm.

Naturally, the time lag between running an engine at idle and at maximum power output will increase considerably compared with engines having governed connections to maximum and minimum gas pressure networks. However, the power output variations may be performed very slowly in a great number of applications resulting in long intervals between overhauls.

Another advantage obtained by the power control device according to the invention is that a single piston ring may be used in the seal between each piston and its adjacent cylinder wall.

As explained, e.g., in U.S. Pat. No. 3,927,529, it is desirable to use double piston rings in order to avoid different mean pressures in the working gas charges of the engine. An engine provided with a power control device according to the invention will automatically obtain equal mean pressures in all charges of working gas. Therefore, a single piston ring will be sufficient and exposed to less wear than any of two rings in a pair mounted on a piston. The movement of the piston is not strictly linear and the more efficient guiding offered by two spaced rings will cause an unnecessary wear.

What is claimed is:

1. A power control device for a double-acting, multi-cylinder hot gas engine of the type in which each cylinder contains a piston dividing the interior of the cylinder into two variable volume chambers containing working gas kept at different temperature levels, the high temperature variable volume chamber in one cylinder being connected to a low temperature variable volume chamber of a neighbouring cylinder via a heater, a regenerator, a cooler, and a cold gas connection connected in series, the device comprising:

a. a gas reservoir;

b. a gas compressor;

c. a check valve connecting said gas reservoir to said gas compressor, said check valve operating to permit gas flow from said gas compressor to said gas reservoir;

d. a plurality of gas conduits corresponding to the number of said cylinders, each of said gas conduits having a first end connected to an individual cold gas connection;

e. a common interconnection connecting the other ends of said gas conduits;

f. a first control valve connecting said common interconnection to said gas reservoir;

g. a second control valve connecting said common interconnection to said gas compressor; and h. means restricting gas flow through each of said gas conduits for maintaining the pressure in said gas conduits substantially equal to the mean pressure of the working gas in said hot gas engine, said restricting means maintaining continuous gas flow communication between each of said gas conduits and its respective cold gas connection.

2. The power control device as recited in claim 1, wherein said means restricting gas flow comprises a capillary tube positioned in each of said gas conduits.

3. The power control device as recited in claim 2, wherein each of said capillary tubes is positioned closely adjacent the first end of its gas conduit.

* * * * *